US006684965B1

(12) United States Patent
Bakke

(10) Patent No.: US 6,684,965 B1
(45) Date of Patent: Feb. 3, 2004

(54) METHOD AND APPARATUS FOR OPERATIONS IN UNDERGROUND SUBSEA OIL AND GAS WELLS

(75) Inventor: Stig Bakke, Algard (NO)

(73) Assignee: Bakke Technology AS, Algard (NO)

( * ) Notice: Subject to any disclaimer, the term of this patent is extended or adjusted under 35 U.S.C. 154(b) by 0 days.

(21) Appl. No.: 10/111,984

(22) PCT Filed: Oct. 23, 2000

(86) PCT No.: PCT/NO00/00352

§ 371 (c)(1),
(2), (4) Date: Sep. 4, 2002

(87) PCT Pub. No.: WO01/31160

PCT Pub. Date: May 3, 2001

(30) Foreign Application Priority Data

Oct. 26, 1999 (NO) ..... 995235

(51) Int. Cl.[7] ..... E21B 4/00
(52) U.S. Cl. ..... 175/99; 166/241.3; 166/55.8
(58) Field of Search ..... 175/97, 99; 166/241.1, 166/241.3, 104, 177.2, 55, 55.1, 55.7, 55.8

(56) References Cited

U.S. PATENT DOCUMENTS 5,794,703 A * 8/1998 Newman et al. ..... 166/381
6,031,371 A * 2/2000 Smart ..... 324/220
6,173,787 B1 * 1/2001 Wittrisch ..... 166/384
6,179,058 B1 * 1/2001 Wittrisch ..... 166/384
6,405,798 B1 * 6/2002 Barrett et al. ..... 166/250.01
6,446,718 B1 * 9/2002 Barrett et al. ..... 166/250.01

FOREIGN PATENT DOCUMENTS

| | | |
|---|---|---|
| SE | 501 283 | 1/1995 |
| WO | WO 90/02864 | 3/1990 |
| WO | WO 91/11652 | 8/1991 |
| WO | WO 93/10326 | 5/1993 |
| WO | WO 95/21987 | 8/1995 |
| WO | WO 00/46481 | 8/2000 |

OTHER PUBLICATIONS

Maritime Well Service AS. "The Well Tractor", (online). <URL:hhtp://www.mws.no/mws.nsf>.

* cited by examiner

*Primary Examiner*—Roger Schoeppel
(74) *Attorney, Agent, or Firm*—Moser, Patterson & Sheridan, L.L.P.

(57) ABSTRACT

A method and apparatus for advancing a rotating motorized downhole tool for operations in oil/gas wells. The apparatus is adapted for drilling and milling away of casing sections in the wells, as preparation for plugging the same. The apparatus includes a rotating tool and a driving motor indirectly suspended on coiled tubing. The apparatus also includes a carriage connected to the motor adapted to absorb torques that occur during use. The carriage is connected to the coiled tubing via a swivel coupling such that a tensile force on the coiled tubing provides an advancing force for the tool and motor.

17 Claims, 6 Drawing Sheets

METHOD AND APPARATUS FOR OPERATIONS IN UNDERGROUND SUBSEA OIL AND GAS WELLS

RELATED APPLICATIONS

This application claims the benefit of the Norwegian application 19995235 filed Oct. 26, 1999 and the international application PCT/NO00/00352 filed Oct. 23, 2000 designating the United States.

BACKGROUND OF THE INVENTION

1. Field of the Invention

The present invention relates to a method of carrying out operations in underground/subsea oil/gas wells, preferably by the utilisation of coiled tubing to carry the work tool. More specifically, this method is meant to be used for advancing a rotating downhole tool in an underwater well, wherein said tool is brought to rotate by means of a downhole motor carried by the coiled tubing. Thereby, the method is of the kind specified in the introduction of claim 1.

2. Description of the Related Art

Also, the invention relates to an apparatus of the kind, which may be employed to implement or support the effect of the method according to the invention, and which comprises a motorized downhole tool, which is arranged to be connected to a pipe string/rod string, preferably coiled tubing, and to receive the torque for the rotation of the tool from the motor. The apparatus according to the invention is thereby of the kind appearing in further detail from the introductory part of the following first independent claim to the apparatus.

Also, the invention comprises a particular application of the method/apparatus.

When the exploitation of a sea-based oil/gas field is considered no longer financially profitable, and the underwater wells are about to be shut down and abandoned, the wells are to be plugged in a reliable manner.

To ensure proper plugging of each of the underwater wells by grouting, the inner casing (run last) must be withdrawn, so that cement mixture can be filled all the way out to the wall of the well. It is not sufficient to fill cement mixture into the inner casing, because formation fluid penetrating into the annulus, could penetrate further up and out of the well if the cement mixture, which has surrounded the casings already from the cementing thereof, is not tight.

To withdraw the (inner) casing, break it up and. transport it to shore is very laborious. Therefore, the oil companies are interested to find a solution, whereby the casing will remain in situ, while at the same time, the well is plugged in accordance with regulations.

This can be achieved by running a cutting tool into the well, cutting away the inner casing in an area below the other casings. A rotating cutting tool is lowered into the casing to the desired depth, where the pivotal blades of the tool are folded out gradually, cutting the casing. Then the tool is displaced in the well while it is rotating and milling and drilling out the casing from the end at the cutting point. When about 15 metres of the casing wall has been drilled out and milled away, the operation is completed, and the equipment can be pulled up. Then, when cement mixture is filled into the inner casing, the cement mixture can penetrate all the way out to the formation in the area from which the casing has been milled away.

Several solutions for milling/drilling tools have been suggested (milling tools, grinding or chipping tools, normally arranged to be mounted in the place of the drill bit).

Since, in general, there are no drill rigs on the platforms normally employed for the implementation of the operations relevant in connection with plugging of underwater wells, which are to be abandoned, it is desirable to be able to use coiled tubing to enter the well with tools. The alternative is to mount a drill rig on the platform, but that is both expensive and time-consuming.

However, coiled tubing will not be able to absorb sufficient torque from the cutting/,milling/drilling tool like an ordinary drill string could have done, and thus it is imperative to have extra torque-absorbing equipment mounted in association with the coiled tubing.

In the technical field of the present invention the insufficient capacity of coiled tubing to absorb torques is considered a qualified problem in connection with motorised rotating downhole tools.

A previously known suggestion, which oil companies have found interesting, involves anchoring a hydraulic piston-and-cylinder, with a piston travel of a couple of metres, at the end of the coiled tubing, and securing an assembly comprising tools with a motor arranged thereto, to the end of the piston rod of the piston-and-cylinder.

In the execution of said downhole operation by means of the rotating motorised tool, a hydraulically expanding clamping ring (or other expanding clamping device) provides for fixing the piston-and-cylinder in the casing and absorbing the torque from the driven rotating tool, while the piston-and-cylinder causes advancing of the tool.

When the piston-and-cylinder has advanced the tool a distance corresponding to a length of stroke, the expanding clamping ring is released, and the apparatus (downhole tool+driving motor) is moved forward a distance corresponding approximately to a length of stroke in the direction of advancing. The clamp ring is tightened again, and the tool is displaced to the milled end of the casing, and the process is repeated.

However, an ordinary hydraulic piston-and-cylinder, in which the piston and piston rod have circular cross-sections, cannot absorb any torque. Therefore, also in this known device extra measures are necessary to handle the torques, such as formation of longitudinal grooves in the piston rod and the slip at the end gable of the cylinder, or so-called splines (grooves, flutes etc.), a particular guide rail or other means can be used. This complicates the equipment and it will all be very expensive.

In accordance with the present invention it has been established, among other things, that apart from its inability to absorb torques, coiled tubing exhibits considerable strength properties and is more than strong enough to endure the advancing force proper.

Thereby the general object of the invention has been to reach and prescribe a method of the kind specified in the introductory part of claim 1, whereby, based on simple operational steps, the drawbacks described in the preceding are remedied, and whereby also in other respects, a technique advantageous in terms of work and time and also economy, is obtained.

SUMMARY OF THE INVENTION

According to the invention the object has been realised through a procedure as specified in the characterising part of claim 1.

The operational steps utilised by the method in order to reach said aim, consist essentially of connecting the downhole motor to a carriage which is arranged partially to drive inside a casing in the well, which is to be plugged, partially to absorb the torque of the downhole motor utilised by the rotatable tool (cutting tool); connecting the carriage to the coiled tubing (or other string not absorbing torques) by a swivel connection in order to avoid transmission of torque from carriage to coiled tubing, and pulling the coiled tubing in order to supply an advancing force to the downhole tool.

The upward advancing represents a simplified method of advancing the downhole cutting tool, and is effected through an upward pull on the coiled tubing. The advancing force that the coiled tubing is thereby subjected to, hardly constitutes more than about five percent of the tension allowed in the coiled tubing. Thus, the coiled tubing is more than strong enough to endure and withstand this advancing force; it is the torques that are problematic by coiled tubing, and the swivel coupling solves this problem in a simple manner. These features in combination provide a technical effect considered to be fairly important within the art in question.

The apparatus according to the invention comprises the above-mentioned particular carriage, which is equipped with driving wheels arranged to be forced radially outwards into bearing abutment on the inner casing wall and thereby absorb the torque through friction.

The wheels are directed along the well, so that the carriage can be displaced along it while the wheels are forced against the inner wall of the casing.

As mentioned in connection with the method according to the invention, the carriage will be connected in use to the coiled tubing by a swivel coupling, so that the carriage can rotate relative to the coiled tubing if the wheel should lose their grip. It is important to prevent the torque from the rotating tool from being la transferred to the coiled tubing, and twisting it about its longitudinal axis, if this should happen.

In use the rotatable shearing/cutting/drilling/milling tool with the associated driving motor is lowered by means of coiled tubing or a similar string to the desired depth in the well, and the wheels of the carriage, which is of a kind described as a "rolling anchor", are forced outwards against the inner casing wall. Each wheel has a radial cylinder arranged thereto, to which pressure fluid is supplied. Pressure in the fluid circulated through the coiled tubing to drive the motor rotating the cutting/milling tool, may be utilised in a known manner to force the carriage/ anchor wheels radially outwards into bearing abutment on the internal wall of the casing. Separate hydraulic pressure fluid (hydraulic oil) may alternatively be supplied through a separate hydraulic line, which runs inside the coiled tubing in a known manner.

The cutting tool first cuts through the casing wall, from inside radially outwards, by shears being folded out (e.g. hydraulically). Then the cutting tool is advanced upwards by the coiled tubing being pulled. Thereby the carriage absorbs the torque from the tool, while the advancing force is being supplied from the coiled tubing.

When coiled tubing is used for the advancing of the downhole tool, and, as mentioned, this is preferred, it is also worth noticing that a condition of this is that the tool is advanced upwards through a pull on the coiled tubing. The coiled tubing cannot provide any particular downward force. However, this upward advancing is not at all disadvantageous for the cutting/milling/drilling work, which is to be carried out by the motorised rotating downhole tool.

In the following there will be described a non-limiting example of a now preferred embodiment of an apparatus for use in the execution of operations in a well, especially in connection with work tools connected indirectly to coiled tubing in order to be advanced (normally upwards) by means thereof. The method according to the invention followed in the advancing of the rotating downhole tool, will appear, at least implicitly, from the description of the constructional configuration and function which distinguish the apparatus, which can be concretised in many different ways within the scope of the present invention which has been set out in the following claims. The term "rolling anchor" is used more or less to associate the carriage to the prevalent term for such drivable devices provided with wheels, relying on friction.

DETAILED DESCRIPTION OF THE PREFERRED EMBODIMENTS

Figure 1:
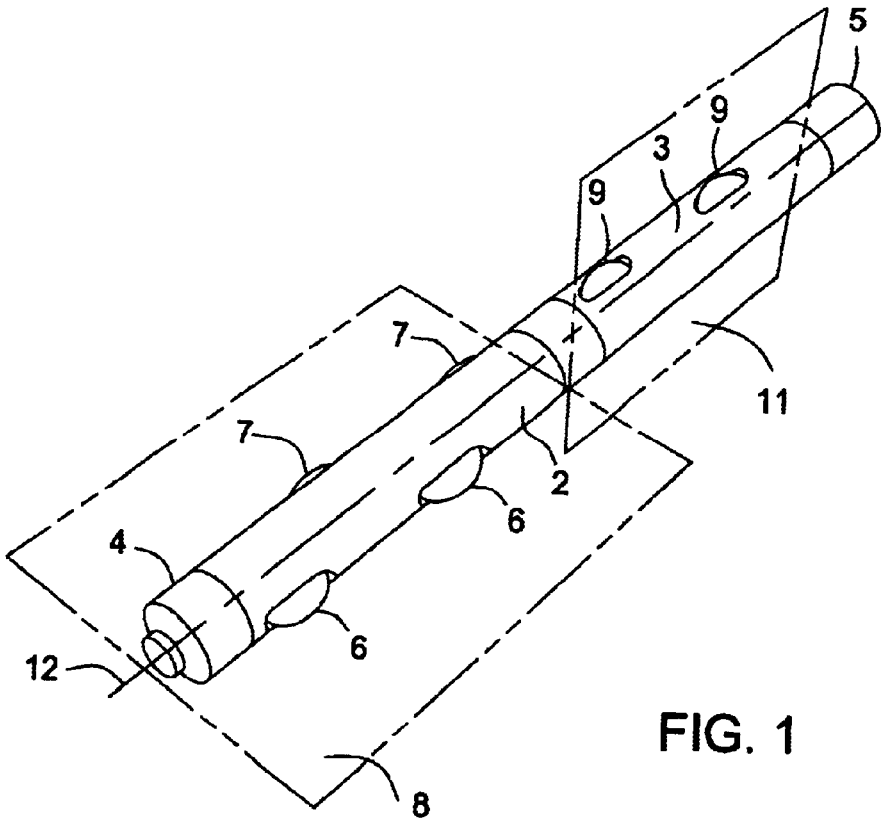
FIG. 1 shows in perspective a carriage of the "rolling anchor" type, which is formed to be connected to coiled tubing (through a swivel) on one side and to a downhole tool with a driving motor on the other side, and which is arranged to drive inside a well along the inner wall surface of the cemented casing thereof.
Figure 2:
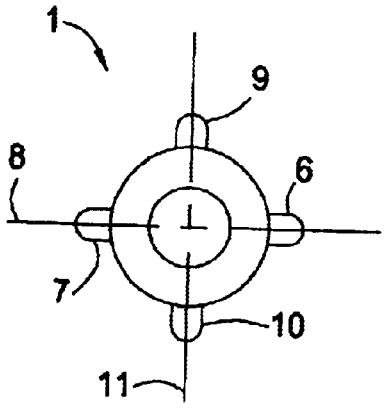
FIG. 2 shows the rolling anchor of FIG. 1, seen from the lower end (in a vertical orientation)

In FIG. 1 the reference numeral 1 identifies a kind of carriage, i.e. in the form of a drivable device, provided with wheels, of the "rolling anchor" type.

For a non-limiting, non-descriptive purpose this carriage is referred to in the following as a rolling anchor or just anchor.

In an upright/vertical orientation, the rolling anchor 1 comprises a lower anchor section 2 and an upper anchor section 3, said anchor sections 2 and 3 being connected to one another. A lower end piece 4 forms an extension of the lower anchor section 2, and an upper end piece 5 forms an extension of the upper anchor section 3. At their free ends, the end pieces 4, 5 are provided with external and internal threads, respectively, so that when being mounted, the anchor 1 can be brought to be incorporated in an ordinary manner in a pipe string together with other well equipment or tools.

Along an axial side portion, the lower anchor section 2 is provided with radial slots extending therethrough (which form outlets for radial cylinders—to be described later), for driving wheels 6 included in a first set of wheels, and has, on the diametrically opposite side portion, a second set of wheels 7 correspondingly arranged thereto.

The wheels 6, 7 are parallel to each other in a common lower wheel plane 8, in which also a longitudinal axis 12 of the lower anchor section 2 is located.

Moreover, in a longitudinal side portion, the upper anchor section 3 is provided with slots therethrough for wheels 9 of a third set of wheels, and has, diametrically opposite the third set of wheels, a fourth set of wheels 10 arranged in a corresponding manner thereto. The wheels 9, 10 are parallel to one another in a common upper wheel plane 11, in which there is also the longitudinal axis 12 of the upper anchor section 3. The longitudinal axes of the anchor sections 3, 2 coincide with the longitudinal axis of the anchor 1 and are collectively identified by 12.

The wheel planes 8, 11 are perpendicular to one another.

A rolling anchor ("carriage") may consist of more than two sections, and the associated wheel planes should then be arranged so that they divide the periphery of the anchor into equal parts. Each wheel 6, 7, 9, 10 is arranged to be displaced radially to contact the internal surface of a casing, which is not shown.

Figure 3:
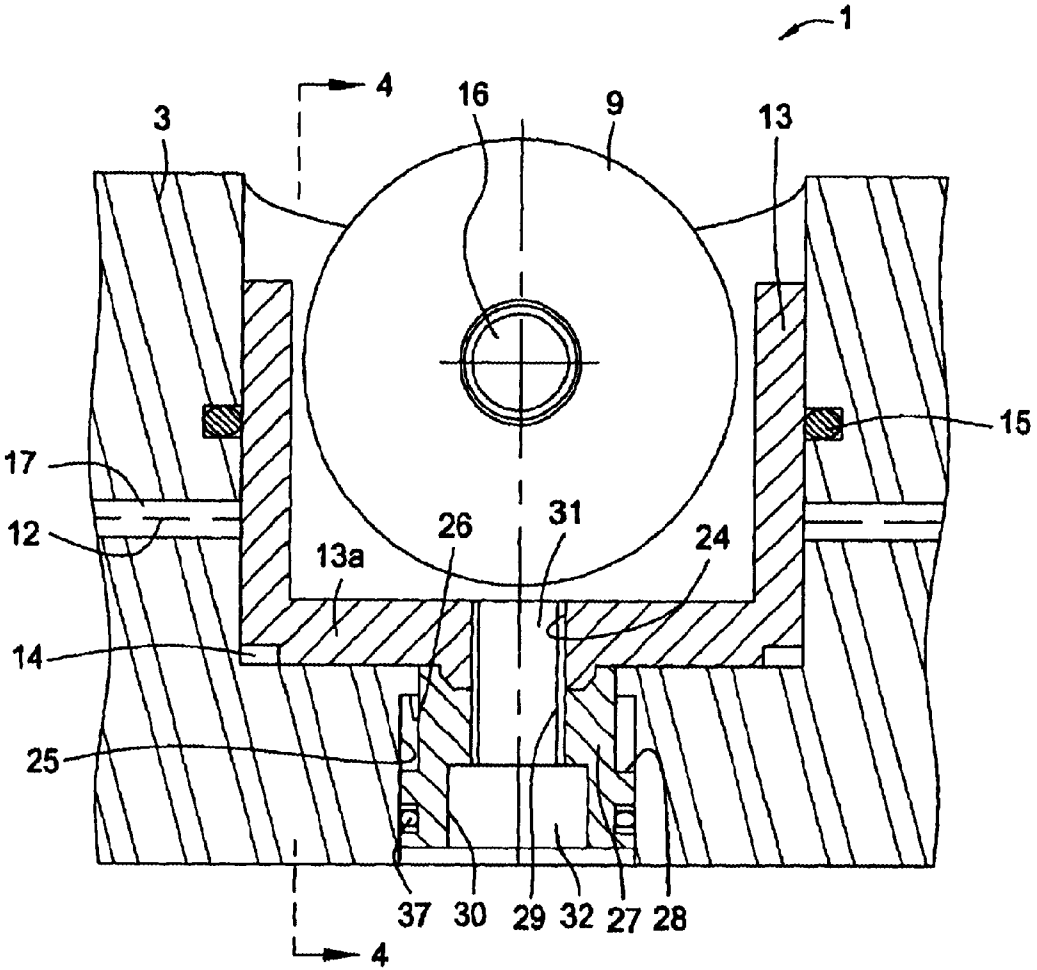
FIG. 3 shows, on a considerably larger scale than that of FIGS. 1 and 2, an axial section along the plane III—III in FIG. 4, and illustrates part of a rolling anchor with a wheel, which can be displaced hydraulically.
Figure 4:
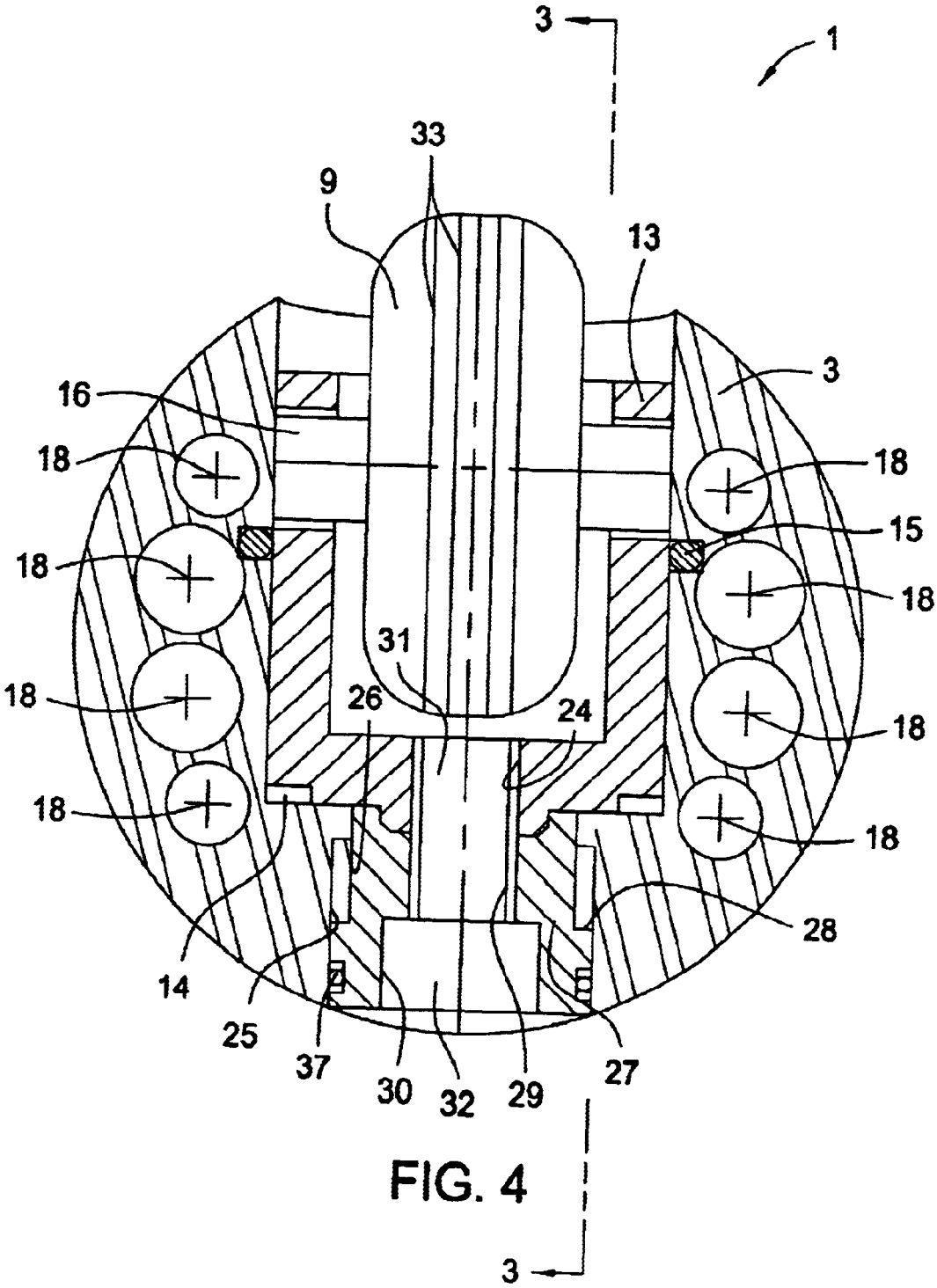
FIG. 4 shows a cross-section, according to the sectional plane IV—IV in FIG. 3, of the anchor part shown therein.

Each wheel 6, 7, 9, 10 has a piston 13 arranged thereto in a radial hydraulic cylinder 14 in the anchor 1, see FIGS. 3 and 4. When the wheels 6, 7, 9, 10 are forced outwards towards said inner casing surface, not shown, the anchor 1 is centred in the casing due to the right-angled intersection of the wheel planes 8, 11, as explained earlier.

Figure 5:
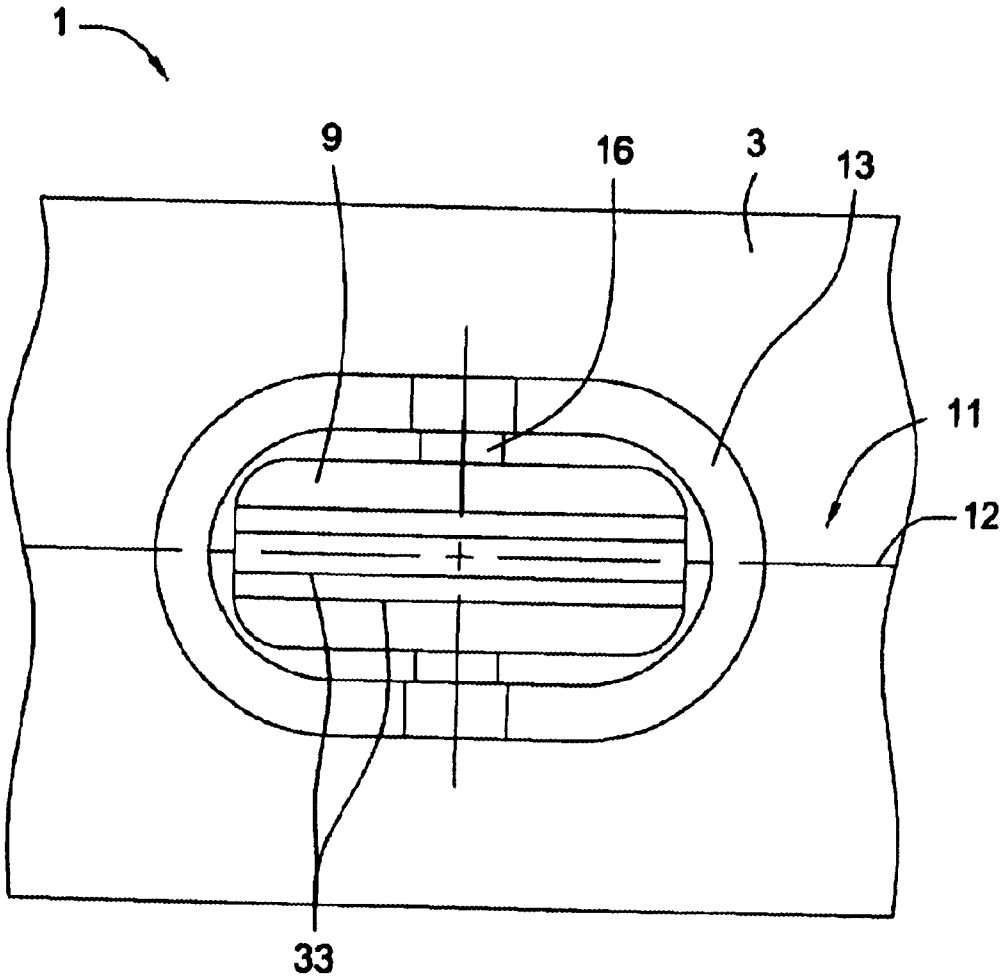
FIG. 5 shows the anchor part of FIG. 3, seen from the top side in this figure.

Reference is now made to FIGS. 3, 4 and 5. In the anchor 1, here represented by the upper anchor section 3, each wheel 9 is arranged in a cup-shaped piston 13, which is arranged to be displaced within the radial, hydraulic cylinder 14, which opens at the surface of the anchor 1, by the "slot" earlier mentioned.

Between the outer side surface of the piston 13 and the opposite side surface of the cylinder, there is arranged a seal 15, sealing between the piston 13 and the cylinder 14. The wheel 9 is attached to a wheel axle 16 rotationally supported in the piston 13. Alternatively, the wheel 9 may be rotationally supported on a wheel axle 16, which is rigidly secured to the piston 13. A narrow, central, hydraulic passage 17 extends through the sections 2, 3 and is arranged to carry pressure fluid to the visible cylinder 14 and corresponding cylinders, not shown, for other wheels 6, 7, 10 arranged to the rolling anchor 1.

The piston 13 and the cylinder 14 have oval cross-sections, as appears from FIG. 5, and from FIGS. 3 and 4 seen together. By oval cross-sections as compared to circular cross-sections is achieved, that large wheels 6, 7, 9, 10 can be used, and at the same time there will be room for longitudinal fluid channels 18 next to the wheel plane 11. The fluid channels 18 serve to carry fluid through the anchor 1. According to FIG. 4 four such narrow channels 18 are arranged on either side of the pistons 13. In addition there is the narrow central passage 17.

Figure 7:
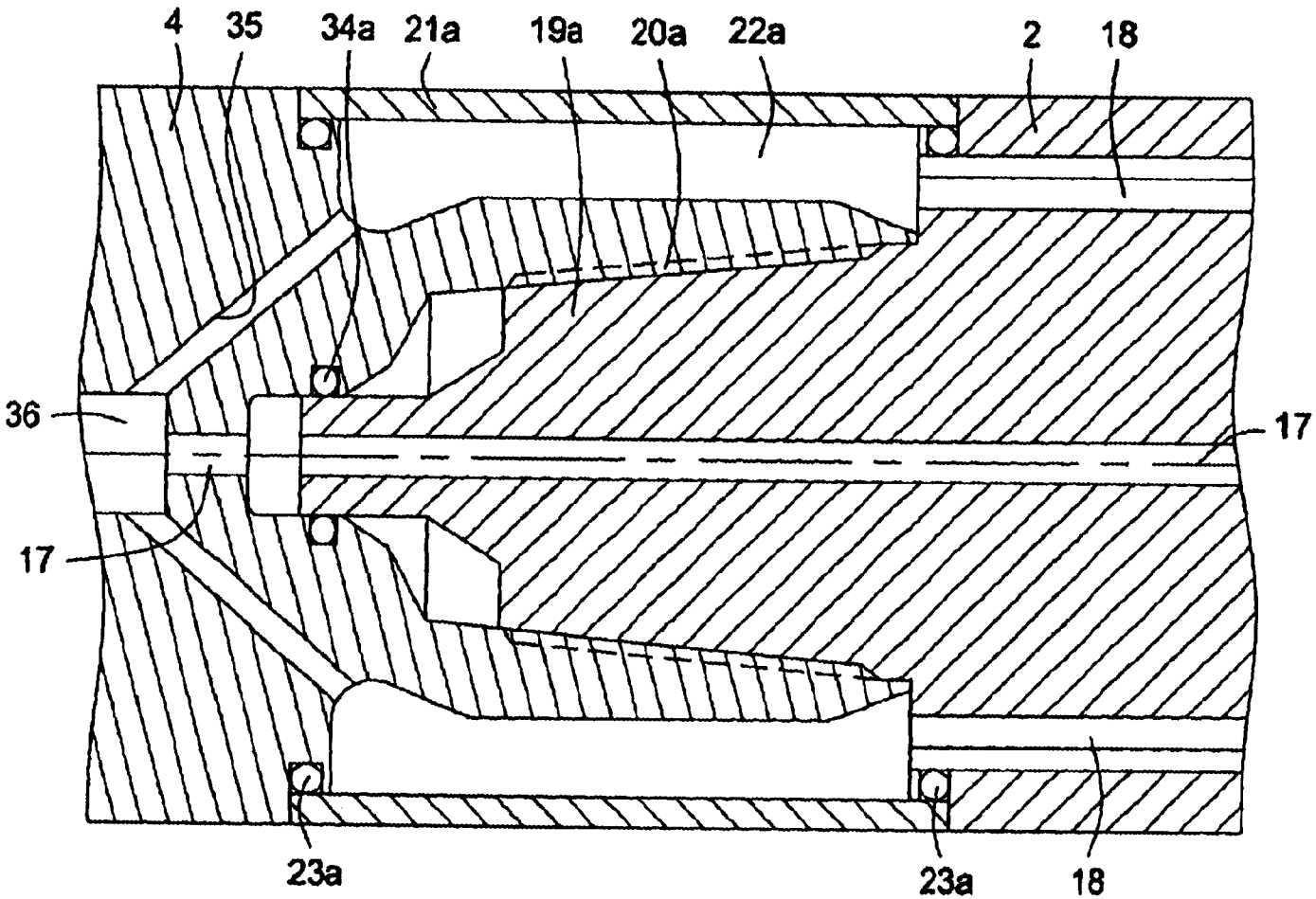
FIG. 7 shows a similar, longitudinal, sectional view of the connection of an anchor section and an end piece (the connection of the other anchor section and a similar end piece being practically identical).

Because of the cylinders 14 a central passage with a sufficiently large flow cross-section cannot be taken through the tool body 1 in the full length thereof; only through its two end pieces 4 and 5, see FIG. 7, where the non-central longitudinal channels 18 are in fluid communication through a peripheral annular space 22*a* with a wide central passage 36 through transition channels 35 oriented at an angle inwards.

In this way the tool body 1 can have a considerable throughput of fluid axially, when the tool is mounted in a pipe string carrying a flow of fluid; this is in spite of the lack of a central passage of a sufficient cross-section for flow (such as the passage cross-section at 36).

Through an oval cross-section is further achieved, that the piston 13 cannot rotate about the axis of the cylinder 14. Therefore, the wheel 9 will always be parallel to the longitudinal axis of the anchor 1. By an oval cross-section there is also achieved a large abutment surface between the cylinder and the piston to absorb the transversal forces arising due to torques acting on the anchor 1.

Through a supply of pressure fluid in the hydraulic passage 17, the piston 13 is displaced radially within the cylinder 14 of the anchor 1, so that the wheel 9 is forced out against the inner surface of a surrounding casing, which is not shown. All wheels 6, 7, 9, 10 operate in a corresponding manner, each of them having a cylinder with a piston arranged thereto, as explained, and each cylinder communicating with the hydraulic passage 17.

Figure 6:
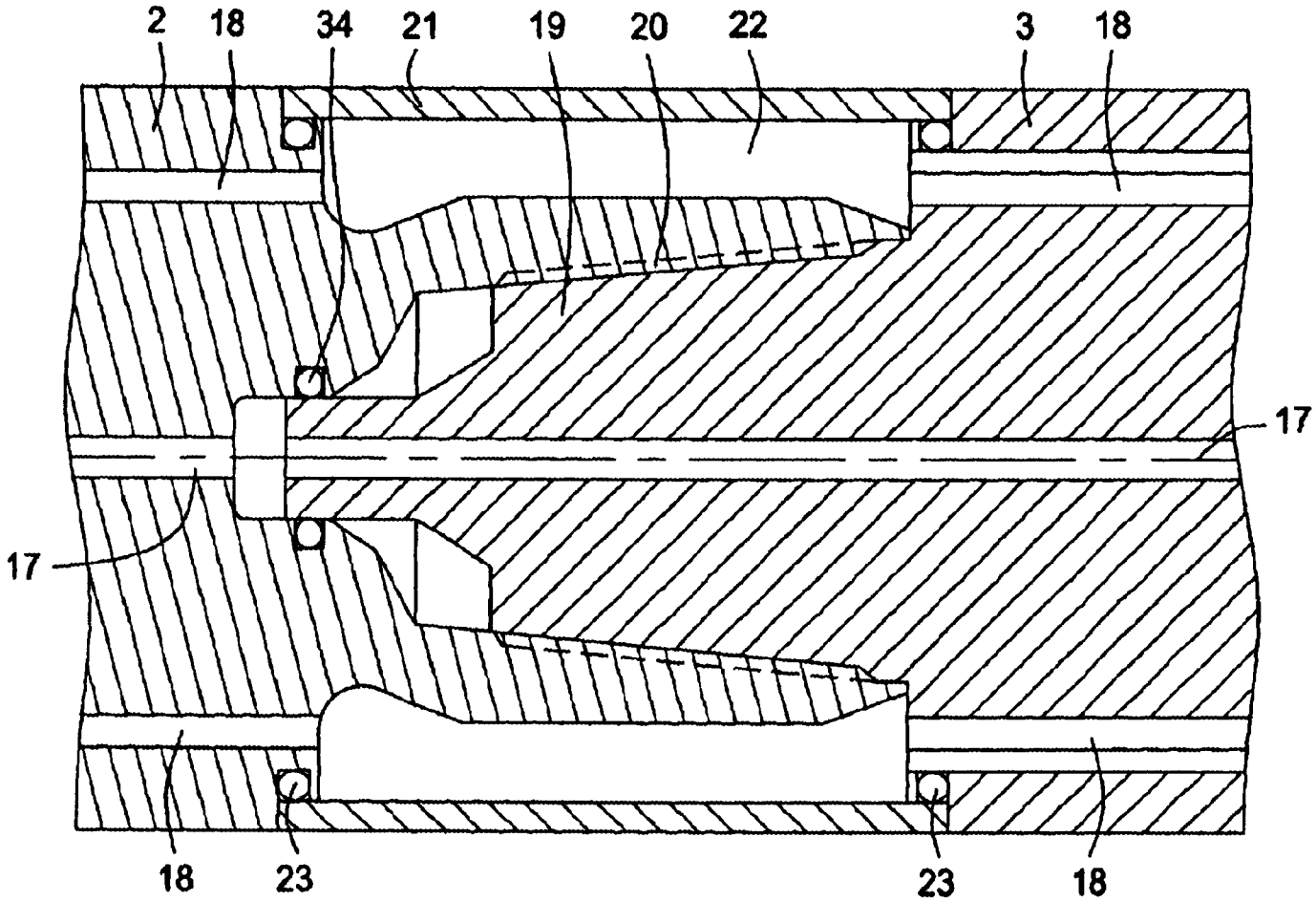
FIG. 6 shows, in a longitudinal section, details of the connecting portions of the apparatus at two anchor sections.

The anchor sections 2, 3 are screwed together, and for this purpose they are provided with complementary threaded portions 19, 20, see FIG. 6.

A sleeve 21 surrounds the threaded portions 19, 20, so that axially between the anchor sections 2, 3 and radially outside the threaded portions 19, 20, there is formed an annular space 22 corresponding to said annular space 22a in FIG. 7. Seals 23 seal between the sleeve 21 and each of the anchor sections 2, 3.

An internal ring gasket 34 seals outwards against fluid flowing in the central passage 17.

Thereby, fluid can flow through the channels 18 in one anchor section 3 to the annular space 22 and further to the channels 18 in the second anchor section 2.

The end pieces 4, 5 are each attached to an anchor section 2, 3 with complementary threaded portions 19*a*, 20*a* and a sleeve 21*a* as explained for the connection between the anchor sections 2, 3.

The connecting and sealing arrangements according to FIG. 7 between the section 2 and its end piece 4 are by and large identical to those of FIG. 6, and comprise, among other things, corresponding gasket rings 23*a* and 34*a*. The transition to the wide central passage 36 of the end piece 4 has been explained earlier.

However, it should be mentioned that the sum of the cross-sectional area of each of the channels 18 and the narrow central passage 17 in an anchor section 2, 3, essentially corresponds to the flow area of said central passage 36 of the end pieces 4 and 5. Couplings and seals between the section 3 and the end piece 5 are identical to those shown in FIG. 7 for the section 2 and the end piece 4.

The upper end of the anchor (carriage) 1 is formed to be screwed together with a swivel coupling, not shown, for connection to the free end portion (not shown) of coiled tubing. The lower end of the anchor (carriage) 1 is formed, for its part, for connection to the tool and the drive motor thereof.

In a particular embodiment, FIG. 1, the individual wheels 6 and 91 respectively, in one row, may be staggered in the longitudinal direction of the carriage/anchor 1 relative to the individual wheels 7 and 10, respectively, in another row within a respective carriage section 2 and 3, respectively.

The wheels 6, 7, 9, 10 may with advantage be provided with grooves 33, FIGS. 4 and 5, extending circumferentially within the tread, which is to bear in a friction-creating manner on the internal surface of a casing.

In FIGS. 3 and 4 there is shown, in addition to the parts, portions and details already described, a device limiting the movement of the piston and thereby of the wheels, and comprising a plug (piston) 27, which is (radially) displaceable in a stepped hole 25 extending through the tool body 1 (in FIGS. 3 and 4 through the anchor section 3). The plug 27 has a hole 29 therethrough, with a concentric widened portion 30 located in a radially outer position.

In the outward (thickened) flange portion of the plug 27, forming the radial inward-facing abutment and stop surface 28 thereof, there is formed a circumferential groove for a gasket ring 37.

At its radially inner end the stepped hole 25 has a concentric widening, so that there is formed a ring surface 26 facing radially outwards, which forms an abutment and stop surface for the radially inward-facing annular flange surface 28 of the plug. At its bottom 13*a* the piston 13 is formed with a central threaded hole 24 into which a headed bolt 31,32 is to be screwed, the shaft 31 thereof being accommodated in the narrowest hole portion 29 of the displaceable plug 27, whereas the head 32, which has too large a diameter to be pulled into the hole portion 29, is accommodated in the radially widened portion 30 of the plug.

Thus, the bolt 31, 32 forms a connecting means between the stop means 27 and the piston 13,13*a*, and this arrangement ensures that the wheels 6, 7, 9, 10 cannot move out of their "engagement with" the tool body 1.

What is claimed is:

1. An apparatus adapted for advancement into a well bore, the apparatus comprising;

an advancable rotating downhole tool;

a driving motor;

coiled tubing having a lower end thereof indirectly connected to the driving motor wherein the coiled tubing minimally absorbs torques;

an elongated carriage comprising a first and a second carriage sections and provided with rotatable driving wheels of fixed orientation, orientated in the longitudinal direction of the carriage, said carriage being equipped with end couplings, one for connection to a free outer end of said coiled tubing through a swivel device, and one for connection to the tool; and a pulling device connected to the coiled tubing for pulling on the coiled tubing for advancing purposes wherein each wheel is positioned and grouped in longitudinal rows within each longitudinal carriage section, the radial central plane of the wheels being in a transversal plane in the respective carriage section, dividing the circumference of the respective carriage section into two halves, and is displaceable in a transversal direction of the carriage through its direct connection to a cylinder-and-piston device in order to be carried by an adjusted/controllable compressive force into friction-creating abutment on an adjacent surrounding internal casing surface or formation wall surface defining the well bore.

2. The apparatus of claim 1, characterized in that the cylinders are in pressure fluid communication with a narrow fluid-carrying passage positioned generally centrally with respect to the carriage sections.

3. The apparatus of claim 2, characterized in that said two carriage sections are formed with several longitudinal channels extending past the cylinders, and providing, together with the narrow central passage, for the tool to have a considerable amount of fluid flowing through, when the tool is mounted in a pipe string carrying a flow of fluid.

4. The apparatus of claim 3, further comprising through transition channels in the respective end couplings arranged such that the longitudinal channels are angled radially inwards in the outward direction axially towards either end coupling, towards a wide central passage formed in the respective end coupling, centrally into which said narrow central passage, which communicates with the cylinders, also opens.

5. The apparatus of claim 3, characterized in that the sum of the cross-sectional areas of the longitudinal channels and said narrow central passage of a carriage section essentially corresponds to the flow area of said wide central passage extending through the respective end coupling connected to the outer end of each carriage section.

6. The apparatus of claim 4, characterized in that each wheel is rotatably supported directly in the piston which has the form of a cup-shaped body of a U-shaped axial section with its outer opening directed outwards in the transversal direction of the carriage, and that this piston and said cylinder thereof have a non-circular cross-section, the piston matchingly engaging the cylinder in a glidingly displaceable manner with a clearance on all sides.

7. The apparatus of claim 6, wherein in a bottom wall of the cylinder, extending generally parallel to the longitudinal central axis of the carriage, the piston has a central attachment hole, whose defining surface is threaded and connectable to a stop arranged to limit the distance of radial outward displacement of the piston and thereby the wheel.

8. The apparatus of claim 7, wherein the stop has the form of an externally cylindrical plug with a bore therethrough, and an outward annular flange, which forms an annular abutment/stop surface facing the piston, and wherein the stop is displaceably arranged in a stepped radial bore in the carriage, which nearest to the piston has a narrowing so that there in a stepped radial bore in the carriage, which nearest to the piston has a narrowing so that there is formed an annular abutment/stop surface facing radially away from the piston and formed to cooperate with the opposite abutment/stop surface facing radially away from the piston and formed to cooperate with the opposite abutment/stop surface the stop, there being secured in the attachment hole of the piston bottom wall with a headed bolt, whose shaft is accommodated in the bore of the stop, which bore has a widening at a distance from the piston, the bolt head being accommodated in said bore widening, ensuring the secure connection of the stop to the piston.

9. The apparatus of claim 1, wherein each wheel includes tread and is provided with grooves extending circumferentially of the wheel within the tread which is to be in contact with the well bore.

10. The apparatus of claim 2, further comprising transversal planes in connection with two adjacent carriage sections arranged and connected in the extension of one another, and wherein the transversal planes, in which the radial central planes of the wheels are located, are essentially perpendicular to one another.

11. The apparatus of claim 2, wherein the individual wheels of one longitudinal row in a transversal plane are staggered in the longitudinal direction of the carriage relative to the individual wheels of another row in the same transversal plane, within the respective carriage section.

12. The apparatus of claim 1, wherein the wheels are individually displaceable in a transversal direction of the carriage.

13. The apparatus of claim 2, wherein the fluid-carrying passage is located generally centrally with respect to the carriage sections.

14. The apparatus of claim 6, wherein the piston and cylinder have an oval cross-section.

15. A method of removing a casing structure in the interior of a well bore, the method comprising:

attaching a generally elongate tool to a first end of a generally elongate carriage having extensible supports contained therein;

attaching an opposite second end of the carriage to a free end of a string such that the carriage can swivel with respect to the string;

inserting the tool and the carriage into the interior of a well at least partially lined with a casing;

inducing the extensible supports into contact with the interior of the well bore; and applying a tensile force to the carriage via the string so as to induce the tool to dislodge the casing such that torque reactions generated by the action of the tool are transmitted via the carriage to the well bore.

16. The method of claim 15, wherein inducing the extensible supports into contact with the well bore comprises applying hydraulic pressure to the supports.

17. The method of claim 15, wherein applying the tensile force to the carriage via the string further induces rolling movement of the supports with respect to the well bore.

* * * * *